US011635082B1

(12) United States Patent
Yao

(10) Patent No.: US 11,635,082 B1
(45) Date of Patent: Apr. 25, 2023

(54) CEILING FAN CONTROLLER FIXING STRUCTURE

(71) Applicant: Chao Chin Yao, Taichung (TW)

(72) Inventor: Chao Chin Yao, Taichung (TW)

( * ) Notice: Subject to any disclaimer, the term of this patent is extended or adjusted under 35 U.S.C. 154(b) by 0 days.

(21) Appl. No.: 17/700,092

(22) Filed: Mar. 21, 2022

(51) Int. Cl.
*F04D 25/08* (2006.01)
*F04D 29/60* (2006.01)

(52) U.S. Cl.
CPC ..... *F04D 25/088* (2013.01); *F04D 29/601* (2013.01)

(58) Field of Classification Search
CPC ..... F04D 25/088; F04D 29/601
USPC ..... 416/244 R
See application file for complete search history.

(56) References Cited

U.S. PATENT DOCUMENTS 5,844,338 A * 12/1998 Horski ..... H02K 11/33 310/90
7,157,872 B1 * 1/2007 Tang ..... H02K 11/33 318/400.41
7,615,898 B2 * 11/2009 Chang ..... H02K 11/33 310/58
2003/0228142 A1 * 12/2003 Reiker ..... F24H 9/1872 392/364
2004/0191087 A1 * 9/2004 Liu ..... F04D 25/088 417/326
2005/0025637 A1 * 2/2005 Liao ..... F04D 27/00 417/326
2005/0201861 A1 * 9/2005 Yoshida ..... F04D 25/0646 415/206
2008/0286101 A1 * 11/2008 Gajewski ..... F24F 7/007 416/23
2009/0224708 A1 * 9/2009 Chen ..... F04D 25/088 318/400.04
2011/0002783 A1 * 1/2011 Yamamoto ..... F04D 29/601 416/30
2012/0194112 A1 * 8/2012 Purohit ..... H02K 11/33 310/90
2017/0204869 A1 * 7/2017 Horng et al. ..... F04D 29/601
2019/0309761 A1 * 10/2019 Wang ..... F04D 25/088
2020/0400162 A1 * 12/2020 He ..... H02K 7/14
2020/0408223 A1 * 12/2020 Kuramochi ..... F21V 29/773
2022/0133941 A1 * 5/2022 Thomsen ..... F04D 25/088 422/121

* cited by examiner

*Primary Examiner* — Logan M Kraft
*Assistant Examiner* — John D Bailey
(74) *Attorney, Agent, or Firm* — Bradley J. Thorson; DeWitt LLP

(57) ABSTRACT

A ceiling fan controller fixing structure includes an intermediate member located between a down rod and a motor. A top end of the intermediate member has a first connecting portion for connecting the down rod. A bottom end of the intermediate member has a second connecting portion for connecting the motor. The intermediate member further has a third connecting portion for connecting a controller module. The controller module has an integrated output cable connector.

4 Claims, 9 Drawing Sheets

CEILING FAN CONTROLLER FIXING STRUCTURE

FIELD OF THE INVENTION

The present invention relates to a ceiling fan, and more particularly to a ceiling fan controller fixing structure.

BACKGROUND OF THE INVENTION

A ceiling fan is mounted to the ceiling of a room, including a down rod extending downwardly from the ceiling, a motor connected to the down rod, and fan blades. The ceiling fan has many electronic components used to control the speed and direction of rotation of the motor, etc. In addition, some ceiling fans are equipped with lamps, so the ceiling fans further include electronic components used to control the lamps. All of these electronic components are wired one by one to get the correct drive. In a conventional ceiling fan, the down rod is provided with a disk. The electronic components of the ceiling fan are disposed on the disk and wired separately. In this way, the exposed wires are unsightly and easily stained, and the wires may be damaged and cause equipment failure.

With the advancement of technology, recent developed ceiling fans provide a casing to cover and protect the electronic components and wires. The shape of the casing may be designed to beautify the ceiling fan. However, the number of electronic components is large, and there are so many wires to be connected. When the ceiling fan is to be assembled, it will take a lot of time to wire one by one. Besides, it is easy to make mistakes in connecting the wires.

Accordingly, the inventor of the present invention has devoted himself based on his many years of practical experiences to solve these problems.

SUMMARY OF THE INVENTION

The primary object of the present invention is to provide a ceiling fan controller fixing structure, which can simply and fix an integrated modular controller on the ceiling fan, thereby simplifying the assembling operation of the ceiling fan and shortening the man-hours.

In order to achieve the object, a ceiling fan controller fixing structure provided by the present invention comprises an intermediate member located between a down rod and a motor. A top end of the intermediate member has a first connecting portion for connecting the down rod. A bottom end of the intermediate member has a second connecting portion for connecting the motor. The intermediate member further has a third connecting portion for connecting a controller module. The controller module has an integrated output cable connector.

Preferably, the intermediate member includes a cylindrical shell. The cylindrical shell is a hollow shell having two openings at its two ends. The first connecting portion is an upper locking hole. The upper locking hole allows a first screw to pass through and lock the down rod. The second connecting portion is a lower locking hole. The lower locking hole allows a second screw to pass through and lock the motor.

In an embodiment, the third connecting portion is a side locking hole. The side locking hole allows a third screw to pass through and lock the controller module. The side locking hole is located between the upper locking hole and the lower locking hole.

In another embodiment, the third connecting portion is a receiving groove passing through the cylindrical shell. The controller module has a protruding pin inserted in the receiving groove so that the controller module is fixed to the cylindrical shell.

Preferably, the receiving groove extends upwardly to a top end of the cylindrical shell. The protruding pin has a T-shaped end. The T-shaped end is clamped against an inner side of the cylindrical shell.

In another embodiment, the intermediate member includes a bottom disk and a post extending upwardly from a central portion of the bottom disk. The post is a hollow post having two openings at its two ends. The first connecting portion is an upper locking hole. The upper locking hole allows a first screw to pass through and lock the down rod. The second connecting portion is a lower locking hole. The lower locking hole allows a second screw to pass through and lock the motor.

Preferably, the third connecting portion is a bottom locking hole. The bottom locking hole allows a third screw to pass through and lock the controller module. The bottom locking hole is defined in the bottom disk.

DETAILED DESCRIPTION OF THE PREFERRED EMBODIMENTS

Embodiments of the present invention will now be described, by way of example only, with reference to the accompanying drawings.

Figure 1:
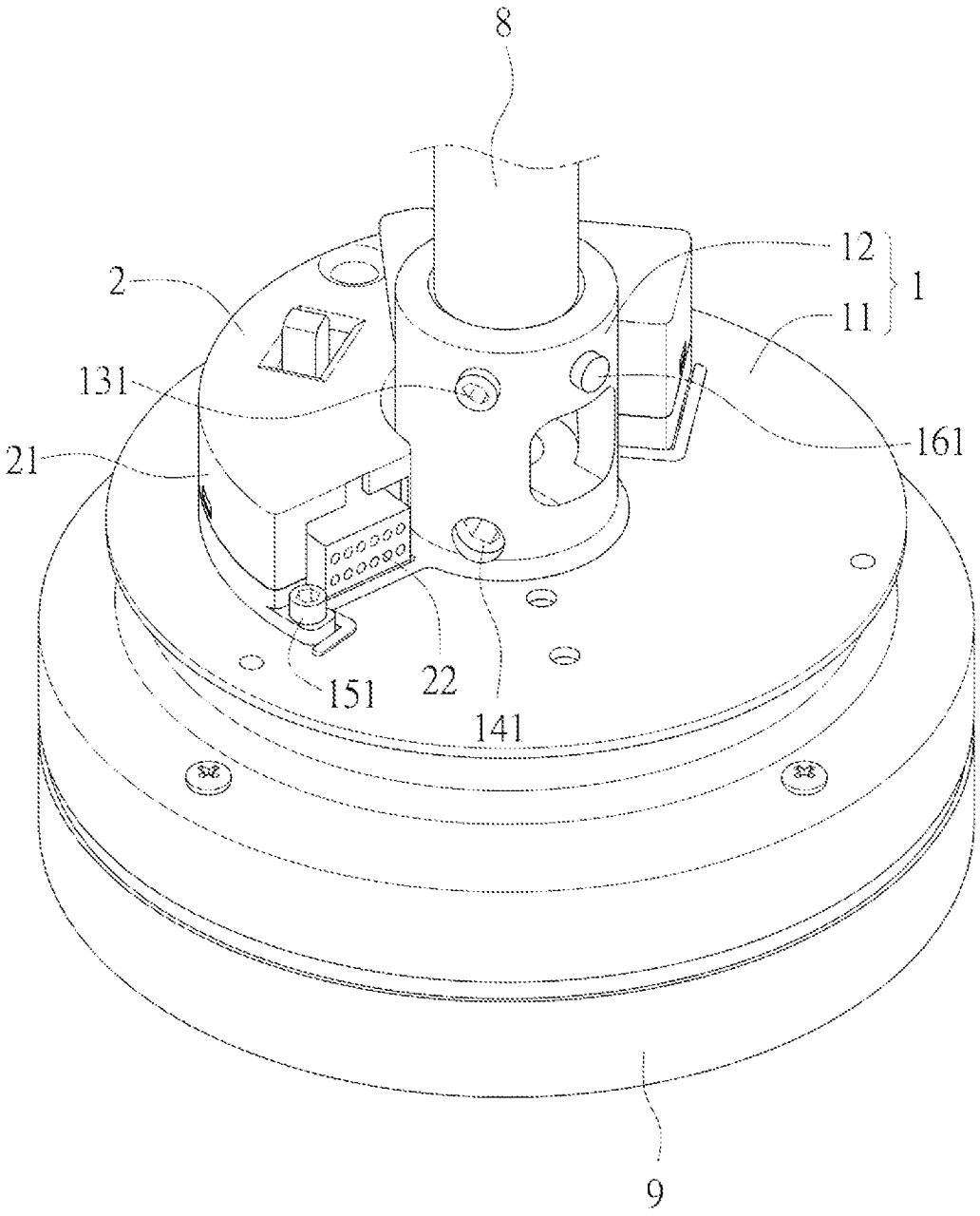
FIG. 1 is a perspective view according to a first embodiment of the present invention.
Figure 2:
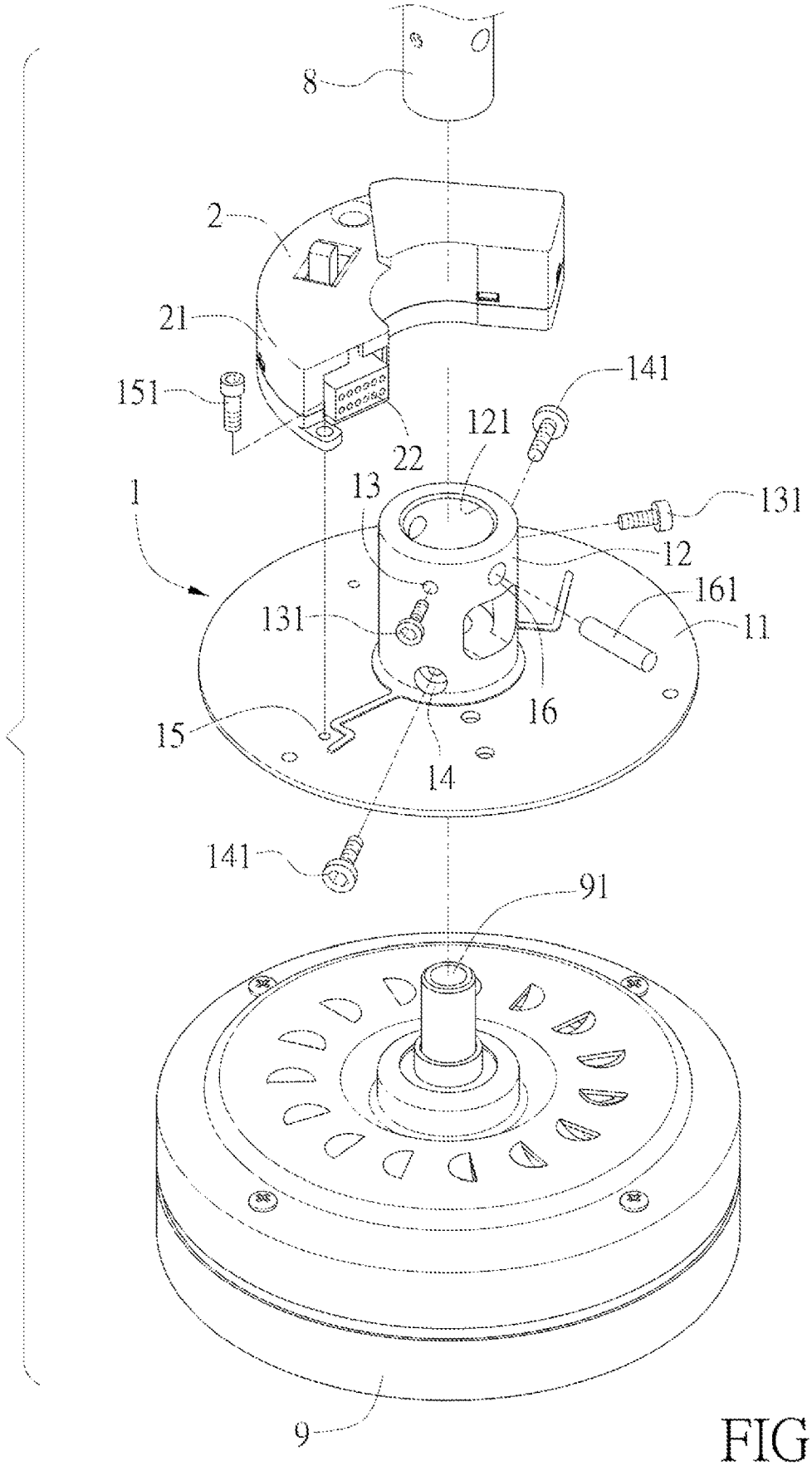
FIG. 2 is an exploded view according to the first embodiment of the present invention.
Figure 3:
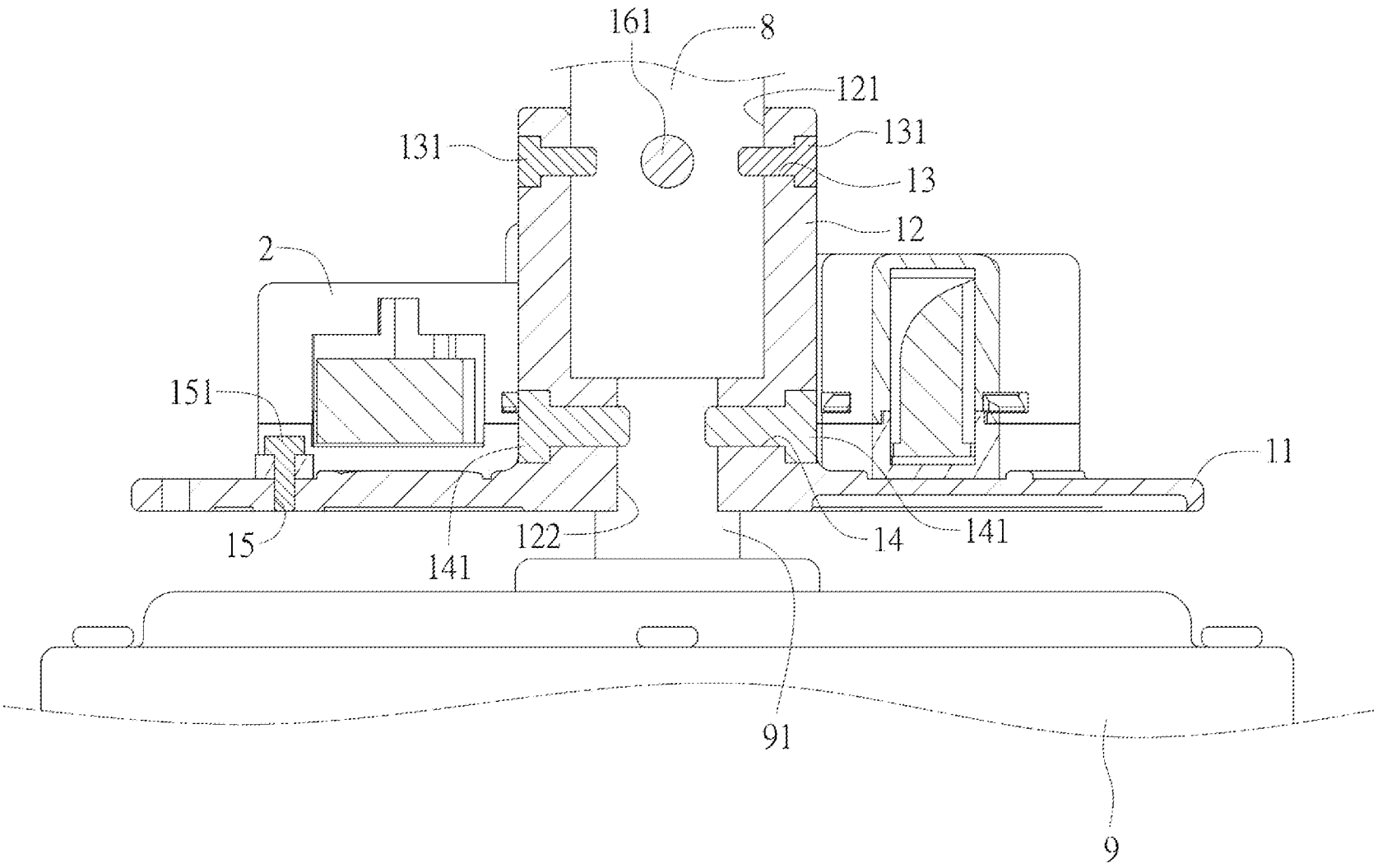
FIG. 3 is a cross-sectional view according to the first embodiment of the present invention.

FIGS. 1-3 illustrate a first embodiment of a ceiling fan controller fixing structure provided by the present invention. The ceiling fan of the present invention includes a down rod 8 and a motor 9. (The ceiling fan further includes a plurality of fan blades connected to the motor 9.) The motor 9 includes a shaft 91 extending outwardly from the center of the motor 9.

In the present invention, an intermediate member 1 is provided between the down rod 8 and the motor 9. The down rod 8 and the motor 9 are connected by the intermediate member 1. In this embodiment, the intermediate member 1 includes a circular bottom disk 11 and an upright post 12 extending upwardly from a central portion of the bottom disk 11. The post 12 is a hollow post having two openings 121, 122 at its upper and lower ends, respectively. The upper opening 121 is configured for insertion of the down rod 8. The lower opening 122 is configured for insertion of the shaft 91 of the motor 9. The top end of the post 12 has a first connecting portion for connecting the down rod 8. The bottom end of the post 12 has a second connecting portion for connecting the motor 9. The post 12 further has a third connecting portion for connecting a controller module 2. In this embodiment, the first connecting portion is an upper locking hole 13. The upper locking hole 13 allows a first screw 131 to pass through and lock the down rod 8 so that the down rod 8 is fixed to the top end of the post 12. The second connecting portion is a lower locking hole 14. The lower locking hole 14 allows a second screw 141 to pass through and lock the shaft 91 of the motor 9 so that the motor 9 is fixed to the bottom end of the post 12. The third connecting portion is a bottom locking hole 15 defined in the bottom disk 11. The bottom locking hole 15 allows a third screw 141 to pass through and lock the controller module 2, so that the controller module 2 is fixed to the post 12.

In addition, the top end of the post 12 further has a pin hole 16. A pin 161 is inserted in the pin hole 16 to pass through the down rod 8, so as to connect the intermediate member 1 with the down rod 8 more stably.

The controller module 2 includes a casing 21 to accommodate various electronic components of the ceiling fan for controlling the operation of the ceiling fan, such as a control unit for controlling the rotation speed of the motor 9 and a forward and reverse rotation control unit for controlling the rotation direction of the motor 9. When the ceiling fan is equipped with lamps, it further includes a control unit for controlling the switch and brightness of the lamps. The wires of the electronic components am integrated to form an output cable connector 22. Because the wires of the electronic components are integrated into the output cable connector 22 according to a predetermined specification or arrangement, the operator can quickly complete the wiring. This can avoid a wrong connection of the wires through a fool-proof mechanism.

When this embodiment is to be assembled with the ceiling fan, the down rod 8 is inserted in the upper opening 121 of the post 12 of the intermediate member 1, and the shaft 91 of the motor 9 is inserted in the lower opening 122 of the post 12, and then the first screw 131 and the second screw 141 pass through the upper locking hole 13 and the lower locking hole 14 to lock the down rod 8 and the shaft 91 respectively, so that the down rod 8 and the motor 9 are connected through the intermediate member 1. Next, the controller module 2 is placed on the bottom disc 11, and then the third screw 151 is inserted in the bottom locking hole 15 to lock the controller module 2, so that the controller module 2 is locked to the intermediate member 1. With the above structure, the assembling operation of the ceiling fan can be simplified. Through the integrated output cable connector 22 of the controller module 2, the wiring operation of the electronic components is simplified, thereby shortening man-hours for assembly and reducing the occurrence of connecting wrong wires.

Figure 4:
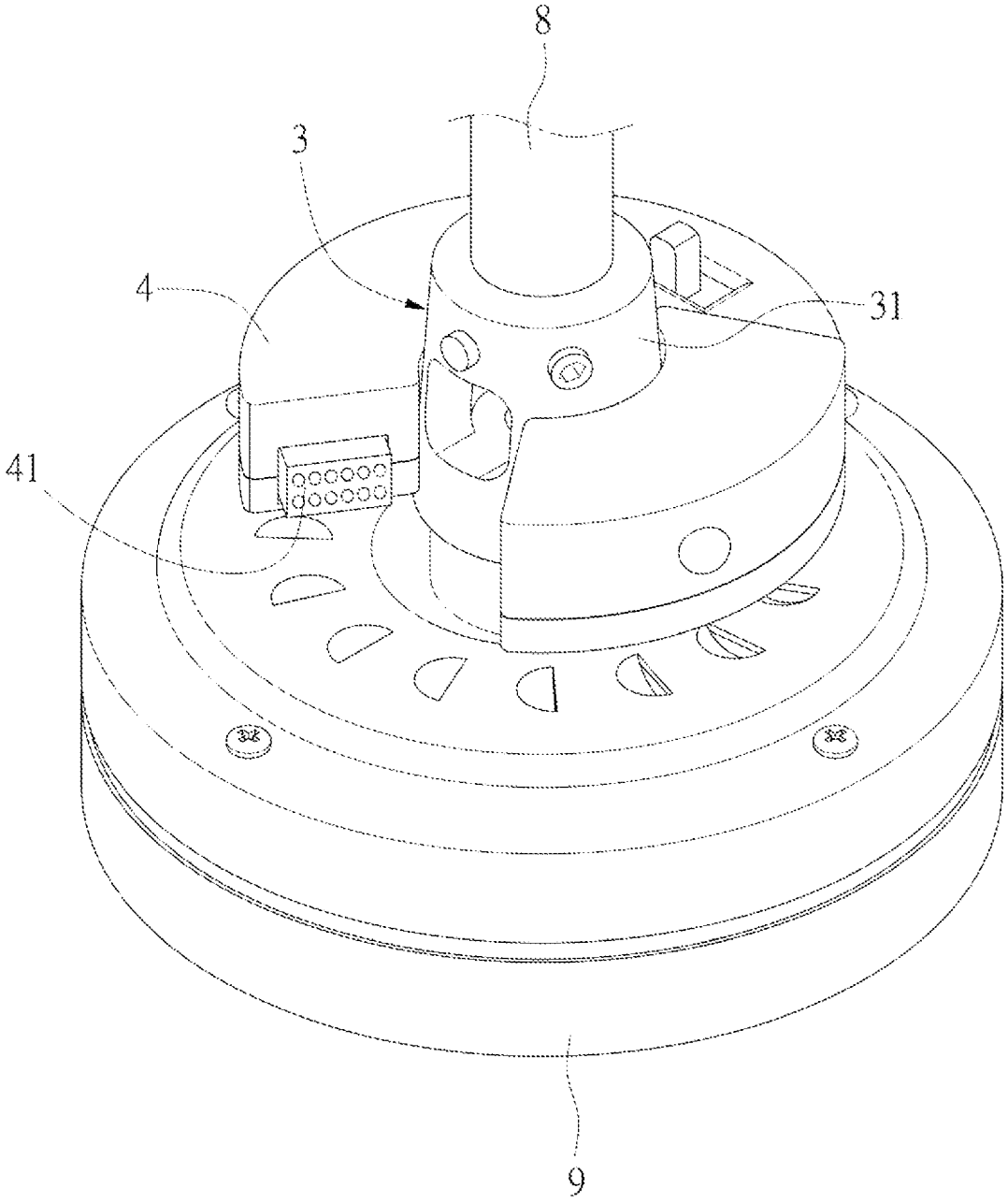
FIG. 4 is a perspective view according to a second embodiment of the present invention.
Figure 5:
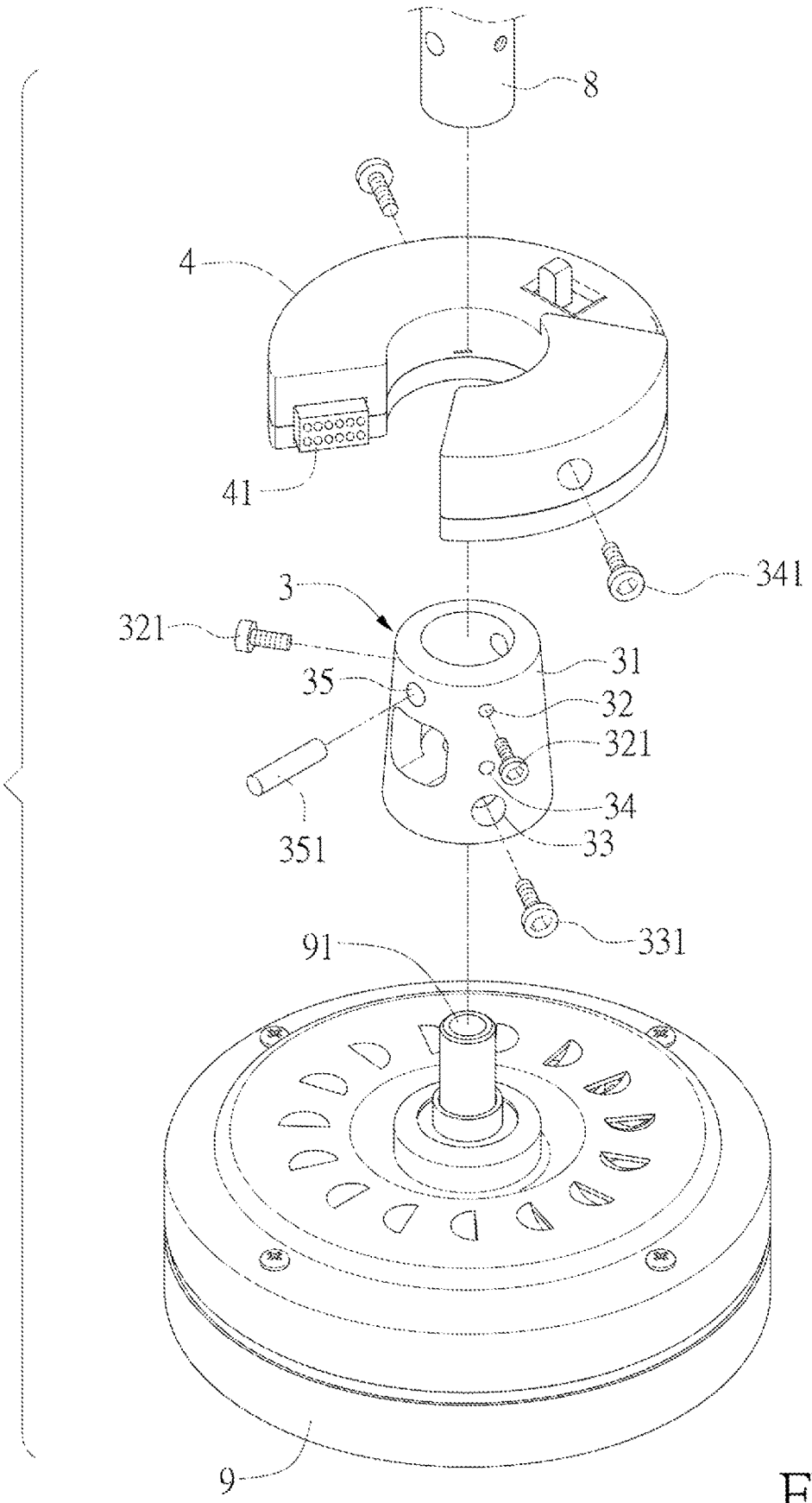
FIG. 5 is an exploded view according to the second embodiment of the present invention.
Figure 6:
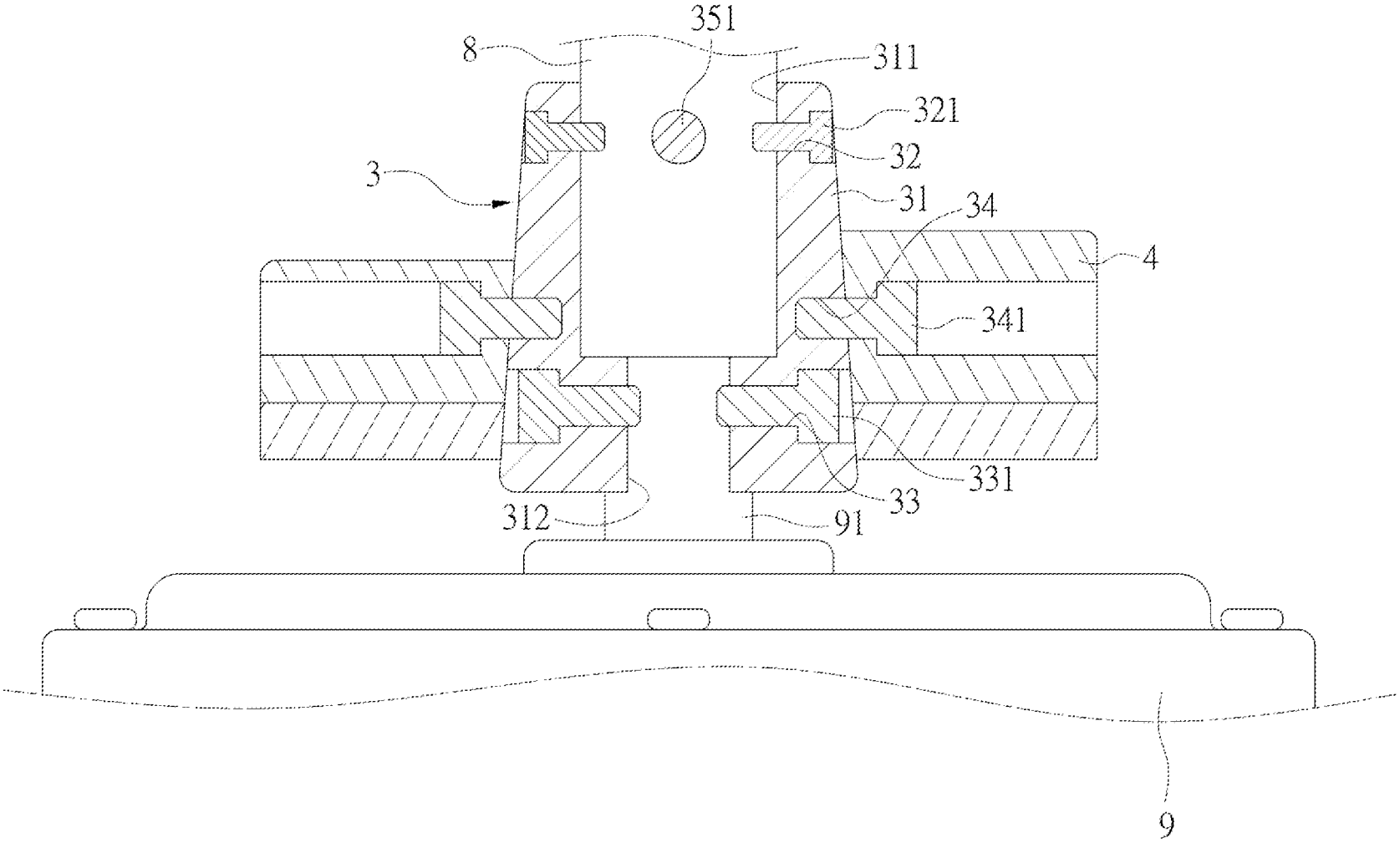
FIG. 6 is a cross-sectional view according to the second embodiment of the present invention.

FIGS. 4-6 illustrate a second embodiment of the present invention. In this embodiment, the intermediate member 3 includes a cylindrical shell 31. The cylindrical shell 31 is a hollow shell having two openings 311, 312 at its upper and lower ends, respectively. The upper opening 311 is configured for insertion of the down rod 8. The lower opening 312 is configured for insertion of the shaft 91 of the motor 9. The top end of the cylindrical shell 31 has a first connecting portion for connecting the down rod 8. The bottom end of the cylindrical shell 31 has a second connecting portion for connecting the motor 9. The cylindrical shell 31 further has a third connecting portion for connecting a controller module 4. In this embodiment, the first connecting portion is an upper locking hole 32. The upper locking hole 32 allows a first screw 321 to pass through and lock the down rod 8 so that the down rod 8 is fixed to the top end of the cylindrical shell 31. The second connecting portion is a lower locking hole 33. The lower locking hole 33 allows a second screw 331 to pass through and lock the shaft 91 of the motor 9 so that the motor 9 is fixed to the bottom end of the cylindrical shell 31. The third connecting portion is a side locking hole 34 located between the upper locking hole 32 and the lower locking hole 33. The side locking hole 34 allows a third screw 341 to pass through and lock the controller module 4 so that the controller module 4 is fixed to the cylindrical shell 31.

In addition, the top end of the cylindrical shell 31 further has a pin hole 35. A pin 351 is inserted in the pin hole 35 to pass through the down rod 8, so as to connect the intermediate member 3 with the down rod 8 more stably.

The structure of the controller module 4 is the same as that of the first embodiment. The wires of electronic components that control the ceiling fan or its attached lamps are integrated to form an output cable connector 41. Because the wires of the electronic components are integrated into the output cable connector 41 according to a predetermined specification or arrangement, the operator can quickly complete the wiring. This can avoid a wrong connection of the wires through a fool-proof mechanism.

When this embodiment is to be assembled with the ceiling fan, the down rod 8 is inserted in the upper opening 311 of the cylindrical shell 31, and the shaft 91 of the motor 9 is inserted in the lower opening 312 of the cylindrical shell 31, and then the first screw 321 and the second screw 331 pass through the upper locking hole 32 and the lower locking hole 33 to lock the down rod 8 and the shaft 91 respectively, so that the down rod 8 and the motor 9 are connected through the intermediate member 3. Next, the controller module 4 is disposed at the side of the cylindrical shell 31, and then the third screw 341 is inserted in the side locking hole 34 to lock the controller module 4, so that the controller module 4 is locked to the intermediate member 3. With the above structure, the assembling operation of the ceiling fan can be simplified. Through the integrated output cable connector 41 of the controller module 4, the wiring operation of the electronic components is simplified, thereby shortening man-hours for assembly and reducing the occurrence of connecting wrong wires.

Figure 7:
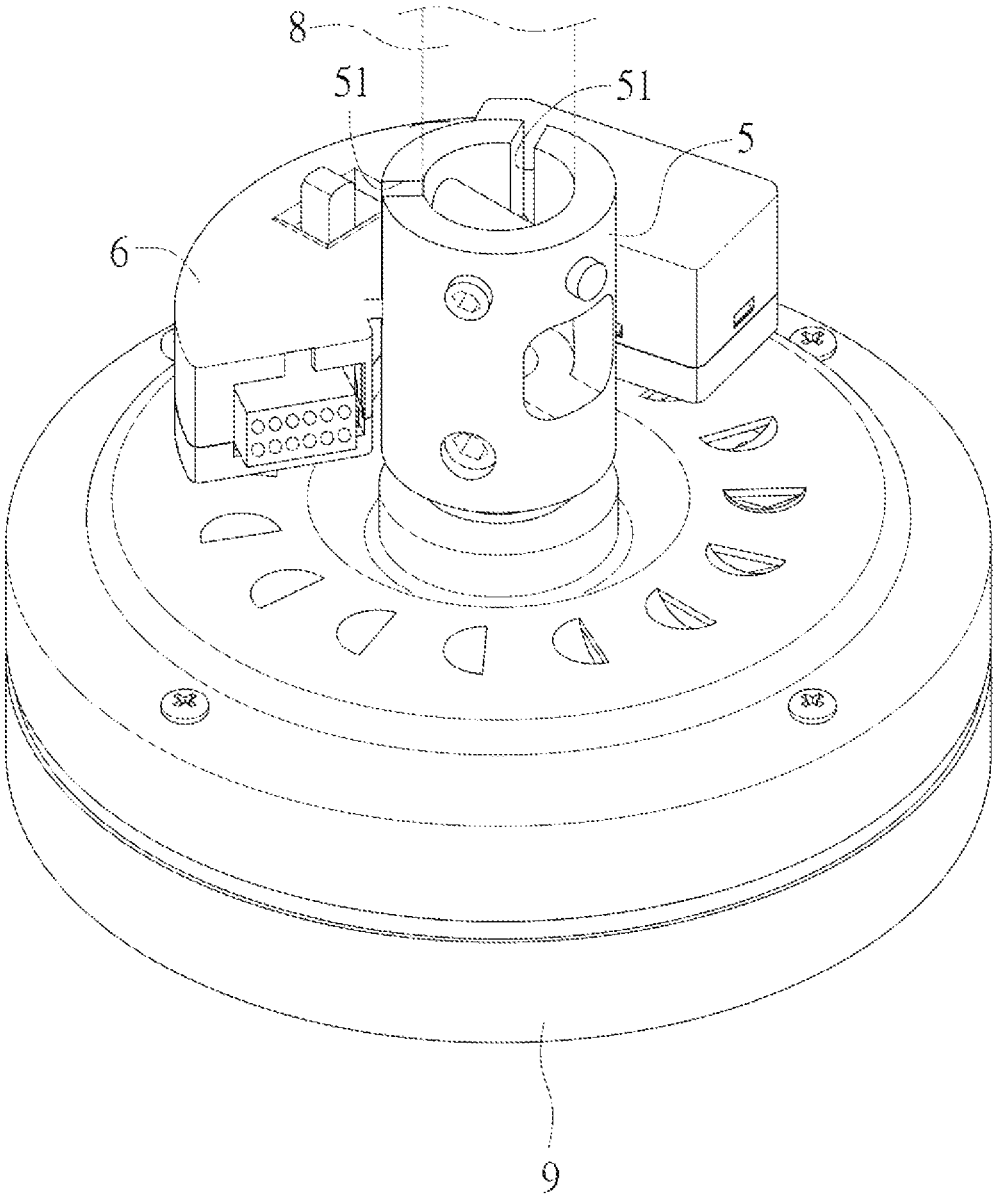
FIG. 7 is a perspective view according to a third embodiment of the present invention.
Figure 8:
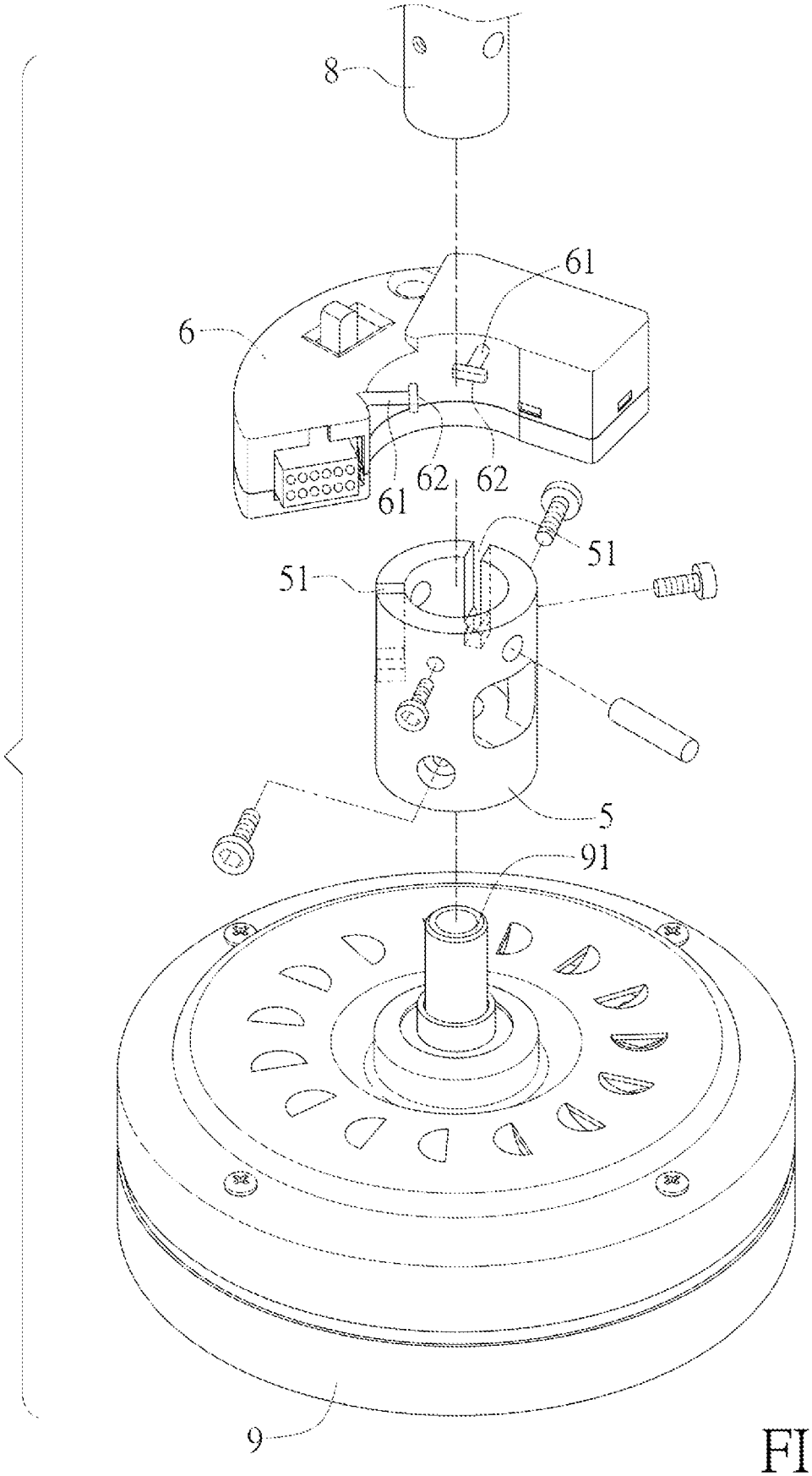
FIG. 8 is an exploded view according to the third embodiment of the present invention.
Figure 9:
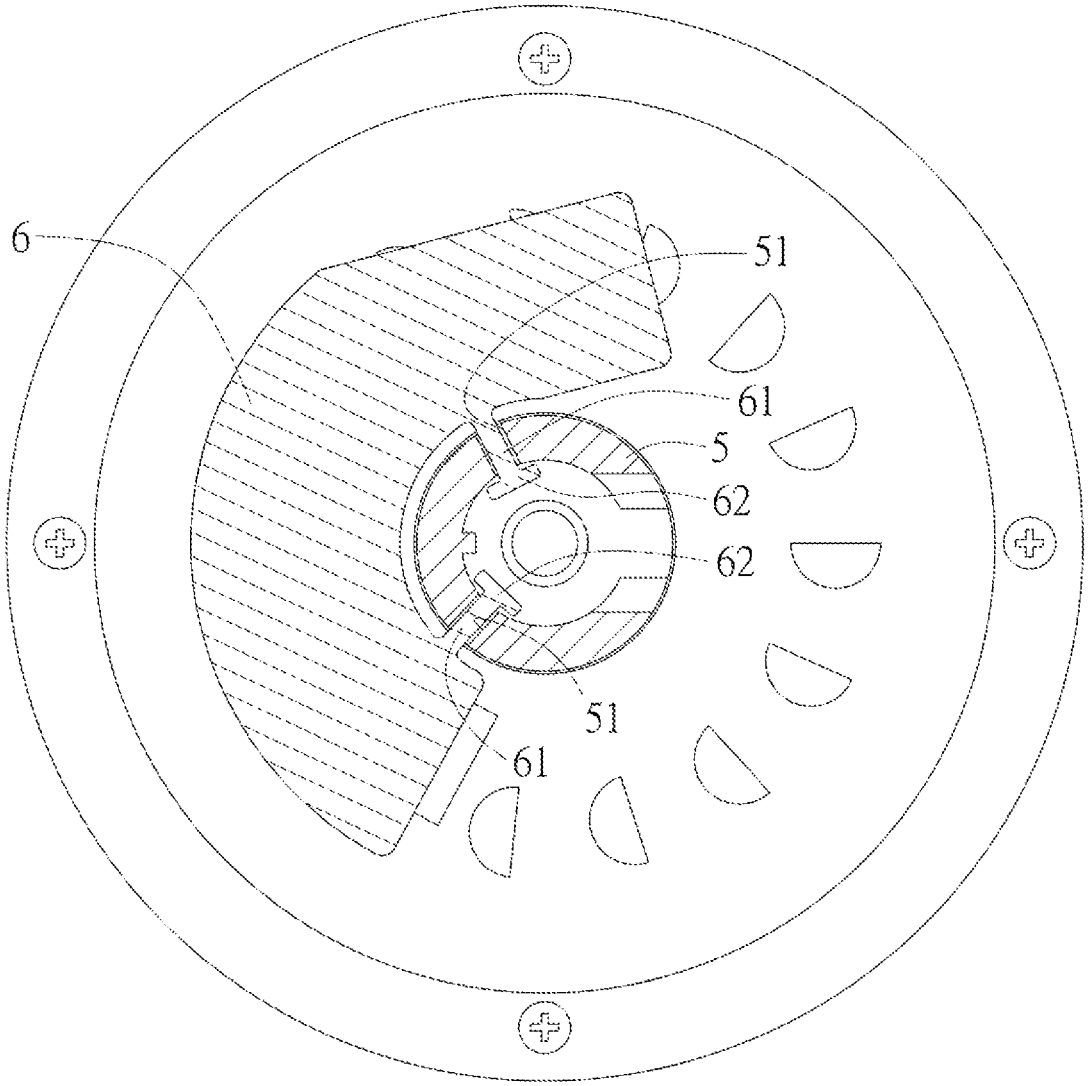
FIG. 9 is a cross-sectional view according to the third embodiment of the present invention.

FIGS. 7-9 illustrate a third embodiment of the present invention. The structure of the third embodiment is based on the structure of the second embodiment, with a structural change in the third connecting portion of the cylindrical shell. In this embodiment, the third connecting portion of the cylindrical shell 5 is two receiving grooves 51 passing through the cylindrical shell 5 laterally. The receiving grooves 51 extend upwardly to the top end of the cylindrical shell 5. On the other hand, the controller module 6 has two protruding pins 61 each having a T-shaped end 62. When the controller module 6 is to be assembled, the body portion of the protruding pin 61 is inserted in the receiving groove 51 from the top of the cylindrical shell 5 downward, and the T-shaped end 62 extends to the inner side of the cylindrical shell 5. Accordingly, the controller module 6 can be tilted by the weight of the controller module 6. At this time, the T-shaped end 62 is stuck on the inner side of the cylindrical shell 5 to position the controller module 6, so that the controller module 6 will not fall off the cylindrical shell 5.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan controller fixing structure comprising an intermediate member located between a down rod and a motor, a top end of the intermediate member having a first connecting portion for connecting the down rod, a bottom end of the intermediate member having a second connecting portion for connecting the motor, the intermediate member further having a third connecting portion for connecting a controller module, wherein the controller module has an integrated output cable connector, wherein the third connecting portion is a receiving groove passing through the cylindrical shell, and the controller module has a protruding pin inserted in the receiving groove so that the controller module is fixed to the cylindrical shell.

2. The ceiling fan controller fixing structure as claimed in claim 1, wherein the receiving groove extends upwardly to a top end of the cylindrical shell, the protruding pin has a T-shaped end, and the T-shaped end is clamped against an inner side of the cylindrical shell.

3. A ceiling fan controller fixing structure comprising an intermediate member located between a down rod and a motor, a top end of the intermediate member having a first connecting portion for connecting the down rod, a bottom end of the intermediate member having a second connecting portion for connecting the motor, the intermediate member further having a third connecting portion for connecting a controller module, wherein the controller module has an integrated output cable connector, wherein the intermediate member includes a bottom disk and a post extending upwardly from a central portion of the bottom disk, the post is a hollow post having two openings at its two ends, the first connecting portion is an upper locking hole, the upper locking hole allows a first screw to pass through and lock the down rod, the second connecting portion is a lower locking hole, and the lower locking hole allows a second screw to pass through and lock the motor.

4. The ceiling fan controller fixing structure as claimed in claim 3, wherein the third connecting portion is a bottom locking hole, the bottom locking hole allows a third screw to pass through and lock the controller module, and the bottom locking hole is defined in the bottom disk.

* * * * *